US010192518B2

(12) United States Patent
Guo

(10) Patent No.: US 10,192,518 B2
(45) Date of Patent: Jan. 29, 2019

(54) DISPLAY METHOD AND DISPLAY DEVICE

(71) Applicants: BOE Technology Group Co., Ltd., Beijing (CN); Beijing BOE Display Technology Co., Ltd., Beijing (CN)

(72) Inventor: Yangchen Guo, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 78 days.

(21) Appl. No.: 15/122,721

(22) PCT Filed: Sep. 23, 2015

(86) PCT No.: PCT/CN2015/090376
§ 371 (c)(1),
(2) Date: Aug. 31, 2016

(87) PCT Pub. No.: WO2016/169205
PCT Pub. Date: Oct. 27, 2016

(65) Prior Publication Data

US 2017/0076690 A1 Mar. 16, 2017

(30) Foreign Application Priority Data

Apr. 20, 2015 (CN) ..... 2015 1 0188622

(51) Int. Cl.
*G09G 5/02* (2006.01)

(52) U.S. Cl.
CPC ..... *G09G 5/02* (2013.01); *G09G 2320/0242* (2013.01); *G09G 2320/0666* (2013.01); *G09G 2330/021* (2013.01); *G09G 2340/06* (2013.01)

(58) Field of Classification Search
None
See application file for complete search history.

(56) References Cited

U.S. PATENT DOCUMENTS 8,232,944 B2 7/2012 Takada et al.
8,314,761 B2 11/2012 Takada et al.
(Continued)

FOREIGN PATENT DOCUMENTS

CN 101510389 A 8/2009
CN 101860762 A 10/2010
(Continued)

OTHER PUBLICATIONS

International Search Report and Written Opinion, including English translation of Box No. V, for International Application No. PCT/CN2015/090376, dated Jan. 7, 2016, 11 pages.
(Continued)

*Primary Examiner* — Xiao Wu
*Assistant Examiner* — Mohammad H Akhavannik
(74) *Attorney, Agent, or Firm* — Westman, Champlin & Koehler, P.A.

(57) ABSTRACT

The present disclosure provides a method and display device for displaying which relates to a display field. The display method comprises steps of: converting a three-channel data of each of pixels in a target image to be displayed to a four-channel data; calculating a color different between the four-channel data after being converted and the three-channel data before being converted; for a pixel the color difference of which meets a preset adjustment condition, decreasing a ratio of a numerical value of a newly added channel in the four-channel data after being converted with respect to the three-channel data before being converted to get an adjusted four-channel data, and displaying by utilizing the adjusted four-channel data; and for the remaining pixels, displaying by utilizing the four-channel data after being converted. The color difference before and after image conversion may be decreased by utilizing the present invention.

12 Claims, 3 Drawing Sheets

(56) References Cited

U.S. PATENT DOCUMENTS

| | | | | |
|---|---|---|---|---|
| 9,245,472 | B2 | 1/2016 | Jang et al. | |
| 9,886,881 | B2 | 2/2018 | Zhang et al. | |
| 2009/0207182 | A1 | 8/2009 | Takada et al. | |
| 2012/0249613 | A1 | 10/2012 | Takada et al. | |
| 2014/0071189 | A1* | 3/2014 | Park | G09G 5/02 345/694 |
| 2014/0184655 | A1 | 7/2014 | Jang et al. | |
| 2015/0154937 | A1 | 6/2015 | Funatsu et al. | |
| 2016/0293082 | A1 | 10/2016 | Zhang et al. | |

FOREIGN PATENT DOCUMENTS

| | | | |
|---|---|---|---|
| CN | 103747223 | A | 4/2014 |
| CN | 103915078 | A | 7/2014 |
| CN | 104091578 | A | 10/2014 |
| CN | 104376833 | A | 2/2015 |
| CN | 104795050 | A | 7/2015 |
| JP | 2006-135744 | A | 5/2006 |
| KR | 10-2013-0030598 | A | 3/2013 |
| WO | 2014024577 | A1 | 2/2014 |

OTHER PUBLICATIONS

First Office Action, including Search Report, for Chinese Patent Application No. 201510188622.6, dated Oct. 31, 2016, 12 pages.

* cited by examiner

DISPLAY METHOD AND DISPLAY DEVICE

CROSS-REFERENCE TO RELATED APPLICATION(S)

This application is a Section 371 National Stage of International Application No. PCT/CN2015/090376, filed 23 Sep. 2015, entitled "DISPLAY METHOD AND DISPLAY DEVICE," which has not yet published, which claims priority to Chinese Application No. 201510188622.6, filed on Apr. 20, 2015, incorporated herein by reference in their entirety.

TECHNICAL FIELD

The present disclosure relates to the display field, and particularly to a display method and a display device.

BACKGROUND

With development of the display technique, most of widely used display device (e.g. display panel, display device and so on) utilizes a RGB (Red, Green, Blue) three color technique, and a RGB data for each of pixels may comprises numerical values for three R, G and B channels. In order to enhance displaying brightness, the RGB three color techniques are improved to generate a RGBW (Red, Green, Blue and White) four color technique. Many display devices are provided with a function of converting the RGB data into the RGBW data.

During a process of converting the RGB data into the RGBW data, a minimum value of the numerical values for the three R, G and B channels is selected, and a calculation is carried out based on a formula $$W_1 = f(x) = 255^*\left(\frac{x}{255}\right)^{\lambda}$$

($\lambda$ is a nonlinear conversion factor, which is normally taken as 2.5) to obtain a numerical value $W_1$ for the W channel in the RGBW data; then, the numerical values for the three R, G and B channels are subtracted by $W_1$ to obtain numerical values $R_1$, $G_1$ and $B_1$ for the three R, G and B channels in the RGBW data so as to get the RGBW data; and finally, the RGBW data is utilized to display and output.

During the process of the present invention, the present inventor finds there are at least the following issues in the prior art.

On the basis of the converting process as mentioned above, a tone is not changed after each of the pixels are converted; however, since incorporation of the numerical value for the W channel, a saturation degree of the respective pixels after conversion are decreased at different levels. Since a chrominance is determined by combination of the tone and the saturation degree, there is a color difference at the respective pixels before and after conversion, so as to lead to a larger color difference before and after conversion.

SUMMARY

In order to solve the issues for the prior art, an embodiment of the present disclosure provides a display method and a display device, which are shown as follows.

In one aspect, there is provided a display method which comprises steps of: converting a three-channel data of each of pixels in a target image to be displayed to a four-channel data; calculating a color different between the four-channel data after being converted and the three-channel data before being converted; for a pixel the color difference of which meets a preset adjustment condition, decreasing a ratio of a numerical value of a newly added channel in the four-channel data after being converted with respect to the three-channel data before being converted to get an adjusted four-channel data, and displaying by utilizing the adjusted four-channel data; and for the remaining pixels, displaying by utilizing the four-channel data after being converted.

Alternatively, the step of decreasing a ratio of a numerical value of a newly added channel in the four-channel data after being converted with respect to the three-channel data before being converted to get an adjusted four-channel data comprises a step of: deceasing a ratio of a numerical value of a newly added channel in the four-channel data after being converted with respect to the three-channel data before being converted to get the adjusted four-channel data for pixels, for which the coordinate points of the four-channel data after being converted and the three-channel data before being converted in the chrominance coordinate system belong to different margin ranges.

Alternatively, the step of deceasing a ratio of a numerical value of a newly added channel in the four-channel data after being converted with respect to the three-channel data before being converted to get the adjusted four-channel data for pixels, for which the coordinate points of the four-channel data after being converted and the three-channel data before being converted in the chrominance coordinate system belong to different margin ranges comprises steps of: determining a boundary of the margin range to which the pixel corresponding to the three-channel data before being converted belongs in the chrominance coordinate system for pixels, for which the coordinate points of the four-channel data after being converted and the three-channel data before being converted in the chrominance coordinate system belong to different margin ranges, determining a connection line from a coordinate point corresponding to the four-channel data after being converted to a coordinate point corresponding to the three-channel data before being converted, and determining an intersection point of the boundary and the connection line; and deceasing a ratio of a numerical value of a newly added channel in the four-channel data after being converted with respect to the three-channel data before being converted to get the adjusted four-channel data for pixels according to a ratio of a distance from the intersection point to the coordinate point corresponding to the three-channel data before being converted to a length of the connection line.

Alternatively, the step of deceasing a ratio of a numerical value of a newly added channel in the four-channel data after being converted with respect to the three-channel data before being converted to get the adjusted four-channel data for pixels according to a ratio of a distance from the intersection point to the coordinate point corresponding to the three-channel data before being converted to a length of the connection line comprises steps of: deceasing a numerical value of the newly added channel in the four-channel data after being converted with respect to the three-channel data before being converted to get an adjustment value of the newly added channel according to a ratio of a distance from the intersection point to the coordinate point corresponding to the three-channel data before being converted to a length of the connection line; and adjusting the numerical value of the other channels in the four-channel data after being converted to get an adjusted four-channel data according to the adjustment value of the newly added channel.

Alternatively, the step of deceasing a numerical value of the newly added channel in the four-channel data after being converted with respect to the three-channel data before being converted to get an adjustment value of the newly added channel according to a ratio of a distance from the intersection point to the coordinate point corresponding to the three-channel data before being converted to a length of the connection line comprises steps of: taking the ratio of a distance from the intersection point to the coordinate point corresponding to the three-channel data before being converted to a length of the connection line as the first adjustment coefficient; and deceasing a numerical value of the newly added channel in the four-channel data after being converted with respect to the three-channel data before being converted to get an adjustment value of the newly added channel according to the first adjustment coefficient and a preset second adjustment coefficient.

Alternatively, the step of deceasing a numerical value of the newly added channel in the four-channel data after being converted with respect to the three-channel data before being converted to get an adjustment value of the newly added channel according to the first adjustment coefficient and the preset second adjustment coefficient comprises a step of: multiplying the numerical value of the newly added channel in the four-channel data after being converted with respect to the three-channel data before being converted by the first adjustment coefficient and the present second adjustment coefficient to get the adjustment value of the newly added channel.

Alternatively, the three-channel is a RGB data and the four-channel data is a RGBW data.

In another aspect, there is provided a display device, which comprises: a conversion unit configured for converting a three-channel data of each of pixels in a target image to be displayed to a four-channel data; an adjustment unit configured for calculating a color different between the four-channel data after being converted and the three-channel data before being converted, and for a pixel the color difference of which meets a preset adjustment condition, configured for decreasing a ratio of a numerical value of a newly added channel in the four-channel data after being converted with respect to the three-channel data before being converted to get an adjusted four-channel data, and a display unit configured for displaying by utilizing the adjusted four-channel data for the pixels the four-channel data of which is adjusted in the target image, and configured for displaying by utilizing the four-channel data after being converted for the pixels except for the pixels the four-channel data of which is adjusted in the target image.

Alternatively, the adjustment unit is configured for deceasing a ratio of a numerical value of a newly added channel in the four-channel data after being converted with respect to the three-channel data before being converted to get the adjusted four-channel data for pixels, for which the coordinate points of the four-channel data after being converted and the three-channel data before being converted in the chrominance coordinate system belong to different margin ranges.

Alternatively, the adjustment unit comprises a determination sub-unit configured for determining a boundary of the margin range to which the pixel corresponding to the three-channel data before being converted belongs in the chrominance coordinate system for pixels, for which the coordinate points of the four-channel data after being converted and the three-channel data before being converted in the chrominance coordinate system belong to different margin ranges, determining a connection line from a coordinate point corresponding to the four-channel data after being converted to a coordinate point corresponding to the three-channel data before being converted, and determining an intersection point of the boundary and the connection line; and an adjustment sub-unit configured for deceasing a ratio of a numerical value of a newly added channel in the four-channel data after being converted with respect to the three-channel data before being converted to get the adjusted four-channel data for pixels according to a ratio of a distance from the intersection point to the coordinate point corresponding to the three-channel data before being converted to a length of the connection line.

Alternatively, the adjustment sub-unit comprises a first adjustment unit configured for deceasing a numerical value of the newly added channel in the four-channel data after being converted with respect to the three-channel data before being converted to get an adjustment value of the newly added channel according to a ratio of a distance from the intersection point to the coordinate point corresponding to the three-channel data before being converted to a length of the connection line; and a second adjustment unit configured for adjusting the numerical value of the other channels in the four-channel data after being converted to get an adjusted four-channel data according to the adjustment value of the newly added channel.

Alternatively, the first adjustment unit comprise a first adjustment sub-unit configured for taking the ratio of a distance from the intersection point to the coordinate point corresponding to the three-channel data before being converted to a length of the connection line as the first adjustment coefficient; and a second adjustment sub-unit configured for deceasing a numerical value of the newly added channel in the four-channel data after being converted with respect to the three-channel data before being converted to get an adjustment value of the newly added channel according to the first adjustment coefficient and a preset second adjustment coefficient.

Alternatively, the second adjustment sub-unit is configured for multiplying the numerical value of the newly added channel in the four-channel data after being converted with respect to the three-channel data before being converted by the first adjustment coefficient and the present second adjustment coefficient to get the adjustment value of the newly added channel.

Alternatively, the three-channel is a RGB data and the four-channel data is a RGBW data.

The technical effect of the embodiment of the present disclosure is shown as follows. In the embodiment of the present disclosure, a three-channel data of each of pixels in a target image to be displayed is converted to a four-channel data; for a pixel the color difference of which meets a preset adjustment condition, a ratio of a numerical value of a newly added channel in the four-channel data after being converted with respect to the three-channel data before being converted is decreased to get an adjusted four-channel data, and it is displayed by utilizing the adjusted four-channel data; and for the pixels except for the pixels the four-channel data of which is adjusted in the target image, it is displayed by utilizing the four-channel data after being converted. Thus, a color difference before and after being converted for some pixels may be decreased so as to decrease color difference before and after image conversion.

BRIEF DESCRIPTION OF THE DRAWINGS

The particular embodiments of the present disclosure will be illustrated by referring to accompany figures so as to definitely explain technical solutions of the embodiments of the present disclosure, in which.

DETAILED DESCRIPTION

In order to make the objects, technical solution and advantages of the present invention be more definite, the embodiments of the present invention will be further illustrated in detail in conjunction with the accompany figures.

Figure 1:
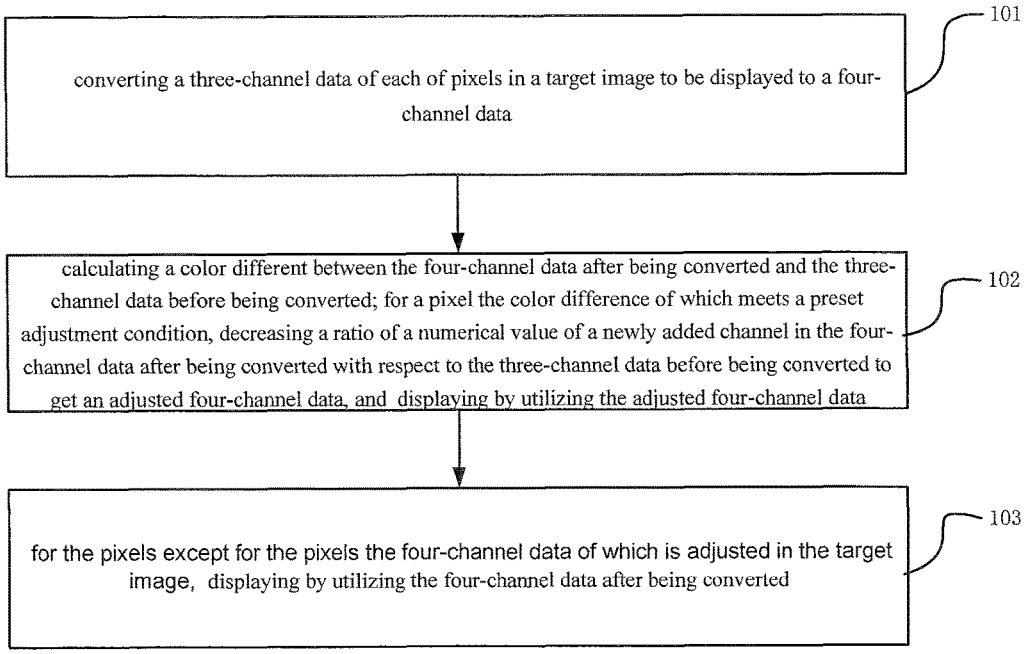
FIG. 1 is a flowchart of a method for displaying according to an embodiment of the present disclosure.

The embodiment of the present disclosure provides a display method. FIG. 1 is a flowchart of a method for displaying according to an embodiment of the present disclosure. As shown in FIG. 1, the process of the present method may comprise following steps of: at step 101, converting a three-channel data of each of pixels in a target image to be displayed to a four-channel data; at step 102, calculating a color different between the four-channel data after being converted and the three-channel data before being converted; at step 103, for a pixel the color difference of which meets a preset adjustment condition, decreasing a ratio of a numerical value of a newly added channel in the four-channel data after being converted with respect to the three-channel data before being converted to get an adjusted four-channel data, and displaying by utilizing the adjusted four-channel data; and at step 104, for the remaining pixels, displaying by utilizing the four-channel data after being converted.

In the embodiment of the present disclosure, a three-channel data of each of pixels in a target image to be displayed is converted to a four-channel data; for a pixel the color difference of which meets a preset adjustment condition, a ratio of a numerical value of a newly added channel in the four-channel data after being converted with respect to the three-channel data before being converted is decreased to get an adjusted four-channel data, and it is displayed by utilizing the adjusted four-channel data; and for the pixels except for the pixels the four-channel data of which is adjusted in the target image, it is displayed by utilizing the four-channel data after being converted. Thus, a color difference before and after being converted for some pixels may be decreased so as to decrease color difference before and after image conversion.

The embodiment of the present disclosure provides a display method, an executing subject of which may be a display device. The display device may be a display panel, a display or the like which is provided with a function of converting a three-channel data into a four-channel data. The three-channel data may be any three-channel data such as RGB data and the four-channel data may be any four-channel data such as RGBW data. In the present embodiment, a situation in which the three-channel data is RGB data and the four-channel data is RGBW data is taken as an example for illustration in detail. Other situations are similar and are omitted for brevity.

The process as shown in FIG. 1 will be illustrated in detail in conjunction with a particular embodiment as follows.

At step 101, a three-channel data of each of pixels in a target image to be displayed is converted to a four-channel data.

Among others, the target image may be one image frame to be displayed by the display device, and the display device may carry out the present process on the all of image frames to be displayed.

In the present embodiment, the process of converting the three-channel data in to the four-channel data may be implemented in any manners and such a step may utilize any converting means. A process of converting the RGB data into the RGBW data is taken as an example. Firstly, a minimum value of the numerical values for the three R, G and B channels is selected, and a calculation is carried out based on a formula of $$W_1 = f(x) = 255^{*}\left(\frac{x}{255}\right)^{\lambda}$$

($\lambda$ is a nonlinear conversion factor, which is normally taken as 2.5) to obtain a numerical value $W_1$ for the W channel in the RGBW data; then, the numerical values for the three R, G and B channels are subtracted by $W_1$ to obtain numerical values $R_1$, $G_1$ and $B_1$ for the three R, G and B channels in the RGBW data so as to get the RGBW data; and finally, the adjusted RGBW data is utilized to display and output. Such a conversion may ensure the tone of image before and after being converted keeps to be constant.

At step 102, a color different between the four-channel data after being converted and the three-channel data before being converted is calculated.

At step 103, for a pixel the color difference of the four-channel data after being converted and the three-channel data before being converted of which meets a preset adjustment condition, a ratio of a numerical value of a newly added channel in the four-channel data after being converted with respect to the three-channel data before being converted is decreased to get an adjusted four-channel data, and displaying by utilizing the adjusted four-channel data.

The preset adjustment conditions is a condition which reflects that the color different is large enough to a certain degree. For example, the preset adjustment condition may be a condition in which the color difference is large enough to be distinguished by naked eyes. There are many means for calculating the color different and different means may correspond to different preset adjustment conditions.

In an implementation, when the RGB data is converted to the RGBW data, the newly added channel is the W channel. During a process of converting data, if the color difference of the RGBW data after conversion and the RGB data before version for a certain pixel is large enough to meet the preset adjustment condition, the numerical value of the W channel may be decreased by a and the numerical values of the three R, G and B channels may be added by a. thus, it may ensure that the tone is kept constant. Meanwhile, since the numerical of the W channel is decreased, i.e. a white component is decreased, a change of the saturation degree of the RGBW data with respect to the RGB data may be also decreased so as to decrease the color difference. For the pixel the RGBW data of which is adjusted, the adjusted RGBW data may be utilized to display.

Alternatively, a chrominance coordinate system may be utilized to determine the color difference before and after conversion. Correspondingly, the step 102 may be carried out as follows: deceasing a ratio of a numerical value of a newly added channel in the four-channel data after being converted with respect to the three-channel data before being converted to get the adjusted four-channel data for pixels, for which the coordinate points of the four-channel data after being converted and the three-channel data before being converted in the chrominance coordinate system belong to different margin ranges.

Figure 2:
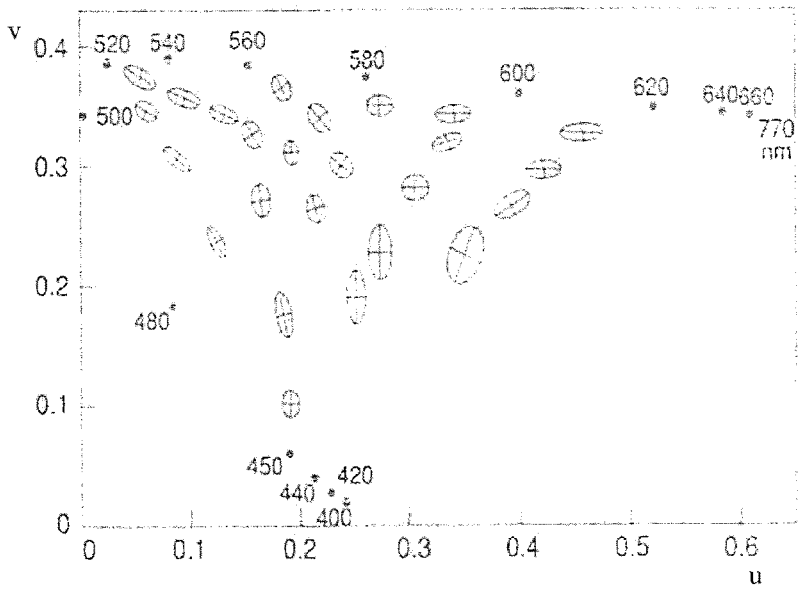
FIG. 2 is a schematic view of a chrominance coordinate system according an embodiment of the present disclosure.

Among others, the chrominance coordinate system may be a coordinate system which quantifies a chrominance by converting the numerical values of the respective channels in the image data into coordinate values. The chrominance coordinate system is provided with corresponding conversion formula for different image data, which is utilized to convert the data of the respective channels in the image data to the coordinate values in the chrominance coordinate system. The margin range is a range which is utilized in the chrominance coordinate system to determine whether the color difference of two pixels (in the present embodiment, the pixels before and after conversion) can be distinguished by human eyes. If the coordinates of two pixels in the chrominance coordinate system is within the same margin range, it indicates that their color difference can't be distinguished by human eyes; otherwise, it indicates that their color difference can be distinguished by human eyes. A large number of margin ranges are provided in the chrominance coordinate system. FIG. 2 is a schematic view of a chrominance coordinate system according an embodiment of the present disclosure. As shown in FIG. 2, it only schematically shows several margin ranges. In an actual chrominance coordinate system, a scope of the margin ranges is wide and can cover the whole color Gamut.

In the implementation, for each of the pixels, the RGBW data after being converted and the RGB data before being converted may be converted to coordinate values in the chrominance coordinate system, respectively. Then, it is determined whether the coordinate points corresponding to the RGBW data after being converted and the RGB data before being converted belong to the same margin range in the chrominance coordinate system. If they do not belong to the same margin range, it indicates that the color difference of the pixels before and after being converted can be distinguished by human eyes, i.e. there is a visual deviation, and the RGBW data of the pixel should be adjusted. If they belong to the same margin range, it indicates that the color difference of the pixels before and after being converted can't be distinguished by human eyes, i.e. there is not a visual deviation, and the RGBW data of the pixel may not be adjusted. The corresponding adjustment is shown in the previous contents.

Alternatively, when the RGBW data of the pixel is adjusted, the coordinate point of the pixel in the chrominance coordinate system is adjusted within the margin range in which the coordinate point corresponding to the RGB data before being converted is located. The corresponding process is shown as follows: for pixels for which the coordinate points of the four-channel data after being converted and the three-channel data before being converted in the chrominance coordinate system belong to different margin ranges, a boundary of the margin range to which the pixel corresponding to the three-channel data before being converted belongs in the chrominance coordinate system is determined, and a connection line from a coordinate point corresponding to the four-channel data after being converted to a coordinate point corresponding to the three-channel data before being converted is determined, and then an intersection point of the boundary and the connection line; and deceasing a ratio of a numerical value of a newly added channel in the four-channel data after being converted with respect to the three-channel data before being converted to get the adjusted four-channel data is determined.

Figure 3:
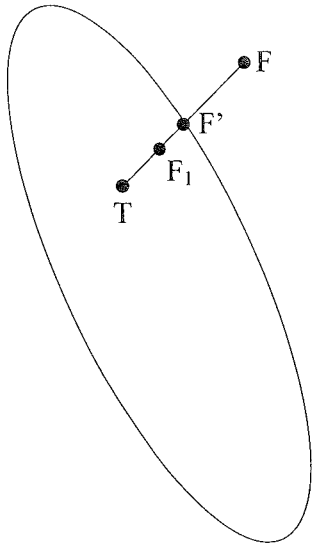
FIG. 3 is a schematic view of a chrominance coordinate system according an embodiment of the present disclosure.

FIG. 3 is a schematic view of a chrominance coordinate system according an embodiment of the present disclosure. In the embodiment and as shown in FIG. 3, T represents a coordinate point of the RGB data before being converted in the chrominance coordinate system and F represents a coordinate point of the RGBW data after being converted in the chrominance coordinate system. The boundary of the margin range to which T belongs may be determined in the chrominance coordinate system, and a connection line between the coordinate points T and F may be determined and then the intersection point F' of the boundary and the connection line may be in turn determined. Then, a ratio of the length of the line segment of TF' in the length of the line segment of TF may be determined. A process of converting the RGBW data or RGB data into coordinate values in the chrominance coordinate system is a linear conversion, and a ratio of the adjusted numerical value b and the numerical value W1 before adjustment for the W channel is identical to the ratio of the line segment of TF' in the line segment TF. The numerical value of b is determined so that the ratio of b and $W_1$ is less than or equal to the ratio of the line segment TF' in the line segment TF according to the ratio of the line segment TF' in the line segment TF, thus, the coordinate point $F_1$ of the adjusted RGBW data in the chrominance coordinate system is within the margin range to which the coordinate point T belongs.

Figure 4:
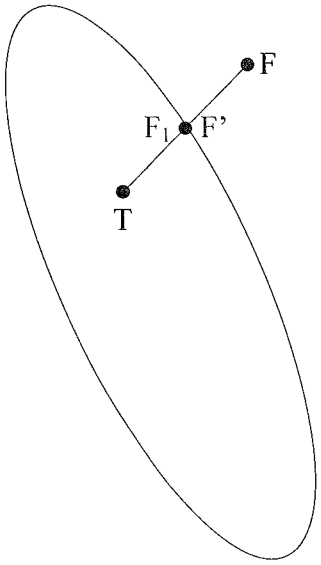
FIG. 4 is a schematic view of a chrominance coordinate system according an embodiment of the present disclosure.

FIG. 4 is a schematic view of a chrominance coordinate system according an embodiment of the present disclosure. Furthermore, as shown in FIG. 4, the coordinate point $F_1$ of the RGBW data in the chrominance coordinate system may be adjusted to the position of the intersection point F' by a corresponding calculation formula as follows:

$$b = \beta W1,\ \beta = \frac{\overrightarrow{TF'}}{\overrightarrow{TF'} + \overrightarrow{F'F}}. \tag{1}$$

Alternatively, in order to ensure that the color tone of the pixel during the adjustment is kept constant, when the numerical value of the W channel is decreased, the numerical values of the R, G and B channel may be increased by a corresponding process as follows: a numerical value of the newly added channel in the four-channel data after being converted with respect to the three-channel data before being converted is decreased to get an adjustment value of the newly added channel according to a ratio of a distance from the intersection point to the coordinate point corresponding to the three-channel data before being converted to a length of the connection line; and the numerical value of the other channels in the four-channel data after being converted is adjusted to get an adjusted four-channel data according to the adjustment value of the newly added channel.

In the implementation, when the numerical value of the W channel is adjusted, the numerical value of the W channel is decreased by b, and the numerical values of the R, G and B channels are increased by b so as to get the final numerical values of the R, G, B and W channels by a corresponding calculation formal as follows:

$$R2=R1+b, G2=G1+b, B2=B1+b \quad (2),$$

in which R1 and R2 are numerical values of the R channel before and after being adjusted, G1 and G2 are numerical values of the G channel before and after being adjusted and B1 and B2 are numerical values of the B channel before and after being adjusted.

Alternatively, in consideration of an objective of decreasing power consumption of the display device, an adjustment coefficient α may be introduced to determine the adjustment numerical value of the W channel. The corresponding process is shown as follows: the ratio of a distance from the intersection point to the coordinate point corresponding to the three-channel data before being converted to a length of the connection line is taken as the first adjustment coefficient (i.e. β); and a numerical value of the newly added channel in the four-channel data after being converted with respect to the three-channel data before being converted is deceased to get an adjustment value of the newly added channel according to the first adjustment coefficient and a preset second adjustment coefficient.

Furthermore, the numerical value of the newly added channel in the four-channel data after being converted with respect to the three-channel data before being converted may be multiplied by the first adjustment coefficient and the present second adjustment coefficient to get the adjustment value of the newly added channel.

In the implementation, the adjustment value b of the W channel may be determined by the calculation formula as follows:

$$b=\alpha\beta W1 \quad (3),$$

in which α represents the preset second adjustment coefficient which is set by adjusting the numerical value of the W channel to decrease power consumption of the display device while the color different is small. The numerical value of α may be determined by statistics of a plurality of experiments.

At step 104, for the remaining pixels except for the pixels the four-channel data of which is adjusted in the target image, it is displayed by utilizing the four-channel data after being converted.

In the implementation, when the data is converted, if the color difference between the RGBW data after being converted and the RGB data before being converted for a certain pixel is small so that it can't meet the preset adjustment condition as mentioned above, the RGBW data may not be adjusted, and it is displayed by directly utilizing the RGBW data without any adjustment.

By employing difference processes for the pixel with a large color different and the pixel with a small color difference, the color difference of the whole target image may be decreased. The target image may be any one image frame during the displaying of the display device.

Figure 5:
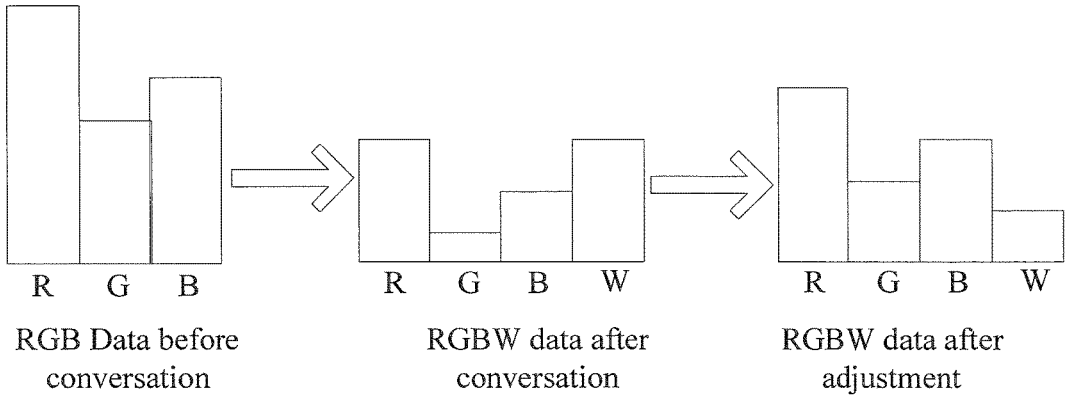
FIG. 5 is a schematic view of RGBW conversion and adjustment according to an embodiment of the present disclosure.

FIG. 5 is a schematic view of RGBW conversion and adjustment according to an embodiment of the present disclosure. As shown in FIG. 5, in the embodiment of the present disclosure, when a three-channel data of each of pixels in a target image to be displayed is converted to a four-channel data, for a pixel the color difference of which meets a preset adjustment condition, a ratio of a numerical value of a newly added channel in the four-channel data after being converted with respect to the three-channel data before being converted is decreased to get an adjusted four-channel data, and it is displayed by utilizing the adjusted four-channel data; and for the pixels except for the pixels the four-channel data of which is adjusted in the target image, it is displayed by utilizing the four-channel data after being converted. Thus, a color difference before and after being converted for some pixels may be decreased so as to decrease color difference before and after image conversion.

Figure 6:
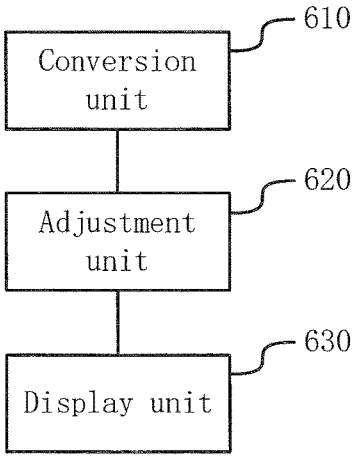
FIG. 6 is a schematic view of configuration of the display device according to an embodiment of the present disclosure.

FIG. 6 is a schematic view of configuration of the display device according to an embodiment of the present disclosure. On the basis of the same technical idea and as shown in FIG. 6, the display device comprises: a conversion unit 610 configured for converting a three-channel data of each of pixels in a target image to be displayed to a four-channel data; an adjustment unit 620 configured for calculating a color different between the four-channel data after being converted and the three-channel data before being converted, and for a pixel the color difference of which meets a preset adjustment condition, configured for decreasing a ratio of a numerical value of a newly added channel in the four-channel data after being converted with respect to the three-channel data before being converted to get an adjusted four-channel data; and a display unit 630 configured for displaying by utilizing the adjusted four-channel data for the pixels the four-channel data of which is adjusted in the target image, and configured for displaying by utilizing the four-channel data after being converted for the pixels except for the pixels the four-channel data of which is adjusted in the target image.

Alternatively, the adjustment unit 620 is configured for deceasing a ratio of a numerical value of a newly added channel in the four-channel data after being converted with respect to the three-channel data before being converted to get the adjusted four-channel data for pixels, for which the coordinate points of the four-channel data after being converted and the three-channel data before being converted in the chrominance coordinate system belong to different margin ranges.

Alternatively, the adjustment unit 620 comprises a determination sub-unit configured for determining a boundary of the margin range to which the pixel corresponding to the three-channel data before being converted belongs in the chrominance coordinate system for pixels, for which the coordinate points of the four-channel data after being converted and the three-channel data before being converted in the chrominance coordinate system belong to different margin ranges, determining a connection line from a coordinate point corresponding to the four-channel data after being converted to a coordinate point corresponding to the three-channel data before being converted, and determining an intersection point of the boundary and the connection line; and an adjustment sub-unit configured for deceasing a ratio of a numerical value of a newly added channel in the four-channel data after being converted with respect to the three-channel data before being converted to get the adjusted four-channel data for pixels according to a ratio of a distance from the intersection point to the coordinate point corresponding to the three-channel data before being converted to a length of the connection line.

Alternatively, the adjustment sub-unit comprises a first adjustment unit configured for deceasing a numerical value of the newly added channel in the four-channel data after being converted with respect to the three-channel data before being converted to get an adjustment value of the newly added channel according to a ratio of a distance from the intersection point to the coordinate point corresponding to the three-channel data before being converted to a length of the connection line; and a second adjustment unit configured for adjusting the numerical value of the other channels in the four-channel data after being converted to get an adjusted four-channel data according to the adjustment value of the newly added channel.

Alternatively, the first adjustment unit comprise a first adjustment sub-unit configured for taking the ratio of a distance from the intersection point to the coordinate point corresponding to the three-channel data before being converted to a length of the connection line as the first adjustment coefficient; and a second adjustment sub-unit configured for deceasing a numerical value of the newly added channel in the four-channel data after being converted with respect to the three-channel data before being converted to get an adjustment value of the newly added channel according to the first adjustment coefficient and a preset second adjustment coefficient.

Alternatively, the second adjustment sub-unit is configured for multiplying the numerical value of the newly added channel in the four-channel data after being converted with respect to the three-channel data before being converted by the first adjustment coefficient and the present second adjustment coefficient to get the adjustment value of the newly added channel.

Alternatively, the three-channel is a RGB data and the four-channel data is a RGBW data.

The technical effect of the embodiment of the present disclosure is shown as follows. In the embodiment of the present disclosure, a three-channel data of each of pixels in a target image to be displayed is converted to a four-channel data; for a pixel the color difference of which meets a preset adjustment condition, a ratio of a numerical value of a newly added channel in the four-channel data after being converted with respect to the three-channel data before being converted is decreased to get an adjusted four-channel data, and it is displayed by utilizing the adjusted four-channel data; and for the pixels except for the pixels the four-channel data of which is adjusted in the target image, it is displayed by utilizing the four-channel data after being converted. Thus, a color difference before and after being converted for some pixels may be decreased so as to decrease color difference before and after image conversion.

The display device disclosed by the present disclosure may be any products or components having a display function, such as liquid crystal panel, electronic paper, mobile phone, tablet computer, television, notebook, digital photo frame, navigator and the like.

It should be noted that when the display device provided by the embodiment as mentioned above is utilized to display, the respective functional modules are only utilized for illustration. In an actual application, the functions as mentioned above can be carried out by different functional modules. That is to say, the internal configuration of the device may be divided into different functional modules to implement all of or a partial of the functions as mentioned above. Furthermore, the display device and the display method provided by the embodiments as mentioned above belong to the same inventive idea and its particular implementation may be referred to the method embodiment and is omitted for brevity.

The sequence number of the embodiment of the present disclosure is only utilized for illustration and does not represent advantages and disadvantages of the embodiments.

It should be understood by those skilled in the art that all of or a partial of the steps of the embodiments as mentioned above may be accomplished by hardware, and may be accomplished by a program which instructs relevant hardware. The program may be stored on a computer readable storage medium which may be a read-only storage, magnetic disk, optical disk and so on.

The above description is only a preferable embodiment of the present disclosure and is not utilized to limit the present invention. Any changes, replacements and modifications within the scope and spirit of the present invention are included in the scope of the present invention.

I claim:

1. A display method, comprising:

converting three-channel data of each of pixels in a target image to be displayed to four-channel data;

calculating a color different between the four-channel data and the three-channel data for each of the pixels;

decreasing, for pixels whose color difference of which meets a preset adjustment condition, a ratio of a numerical value of a newly added channel in the four-channel data with respect to the three-channel data to obtain an adjusted four-channel data; and displaying the target image by using the adjusted four-channel data for the pixels the four-channel data of which is adjusted and using the four-channel data for the pixels the four-channel data of which is not adjusted;

wherein deceasing the ratio of the numerical value of the newly added channel in the four-channel data with respect to the three-channel data to obtain the adjusted four-channel data so that coordinate points of the adjusted four-channel data and coordinate points of the three-channel data belong to same margin ranges in a chrominance coordinate system.

2. The display method according to claim 1, wherein the deceasing the ratio of a numerical value of a newly added channel in the four-channel data with respect to the three-channel data to obtain the adjusted four-channel data for pixels further comprises:

determining a boundary of the margin range to which the pixel corresponding to the three-channel data belongs in the chrominance coordinate system for pixels, for which the coordinate points of the four-channel data and the three-channel data before being converted in the chrominance coordinate system belong to different margin ranges, determining a connection line from a coordinate point corresponding to the four-channel data to a coordinate point corresponding to the three-channel data, and determining an intersection point of the boundary and the connection line; and deceasing the ratio of a numerical value of a newly added channel in the four-channel data with respect to the three-channel data to obtain the adjusted four-channel data for pixels according to a ratio of a distance from the intersection point to the coordinate point corresponding to the three-channel data to a length of the connection line.

3. The display method according to claim 2, wherein the deceasing the ratio of a numerical value of a newly added channel in the four-channel data with respect to the three-channel data to obtain the adjusted four-channel data for pixels according to the ratio of the distance from the intersection point to the coordinate point corresponding to the three-channel data to a length of the connection line further comprises:

deceasing a numerical value of the newly added channel in the four-channel data with respect to the three-channel data to obtain an adjustment value of the newly added channel according to a ratio of a distance from the intersection point to the coordinate point corresponding to the three-channel data to a length of the connection line; and adjusting the numerical value of the other channels in the four-channel data according to the adjustment value of the newly added channel.

4. The display method according to claim 3, wherein the deceasing the numerical value of the newly added channel in the four-channel data with respect to the three-channel data to get an adjustment value of the newly added channel according to a ratio of a distance from the intersection point to the coordinate point corresponding to the three-channel data to the length of the connection line further comprises:

using the ratio of the distance from the intersection point to the coordinate point corresponding to the three-channel data to the length of the connection line as a first adjustment coefficient; and deceasing the numerical value of the newly added channel in the four-channel data with respect to the three-channel data to obtain the adjustment value of the newly added channel according to the first adjustment coefficient and a preset second adjustment coefficient.

5. The display method according to claim 4, wherein the deceasing the numerical value of the newly added channel in the four-channel data with respect to the three-channel data to obtain the adjustment value of the newly added channel according to the first adjustment coefficient and the preset second adjustment coefficient further comprises:

multiplying the numerical value of the newly added channel in the four-channel data with respect to the three-channel data by the first adjustment coefficient and the present second adjustment coefficient to obtain the adjustment value of the newly added channel.

6. The display method according to claim 1, wherein the three-channel is a RGB data and the four-channel data is a RGBW data.

7. A display device configured to:

convert three-channel data of each of pixels in a target image to be displayed to four-channel data;

calculate a color different between the four-channel data and the three-channel data for each of the pixels, and decrease, for pixels whose color difference meets a preset adjustment condition, a ratio of a numerical value of a newly added channel in the four-channel data with respect to the three-channel data to obtain an adjusted four-channel data, and display the target image by using the adjusted four-channel data for the pixels the four-channel data of which is adjusted, and using the four-channel data for the pixels the four-channel data of which is not adjusted;

wherein the display device is further configured to decease the ratio of the numerical value of the newly added channel in the four-channel data with respect to the three-channel data to obtain the adjusted four-channel data so that coordinate points of the adjusted four-channel data and coordinate points of the three-channel data belong to same margin ranges in a chrominance coordinate system.

8. The display device according to claim 7, further configured to:

determine a boundary of the margin range to which the pixel corresponding to the three-channel data belongs in the chrominance coordinate system for pixels, for which the coordinate points of the four-channel data and the three-channel data in the chrominance coordinate system belong to different margin ranges, determine a connection line from a coordinate point corresponding to the four-channel data to a coordinate point corresponding to the three-channel data, and determining an intersection point of the boundary and the connection line, and decrease the ratio of the numerical value of a newly added channel in the four-channel data with respect to the three-channel data to obtain the adjusted four-channel data for pixels according to a ratio of a distance from the intersection point to the coordinate point corresponding to the three-channel data to a length of the connection line.

9. The display device according to claim 8, further configured to:

decrease the numerical value of the newly added channel in the four-channel data with respect to the three-channel data to obtain an adjustment value of the newly added channel according to a ratio of a distance from the intersection point to the coordinate point corresponding to the three-channel data to a length of the connection line; and adjust the numerical value of the other channels in the four-channel data according to the adjustment value of the newly added channel.

10. The display device according to claim 9, further configured to:

use the ratio of the distance from the intersection point to the coordinate point corresponding to the three-channel data to the length of the connection line as a first adjustment coefficient; and decrease the numerical value of the newly added channel in the four-channel data with respect to the three-channel data to obtain the adjustment value of the newly added channel according to the first adjustment coefficient and a preset second adjustment coefficient.

11. The display device according to claim 10, further configured to multiply the numerical value of the newly added channel in the four-channel data with respect to the three-channel data by the first adjustment coefficient and the present second adjustment coefficient to obtain the adjustment value of the newly added channel.

12. The display device according to claim 7, wherein the three-channel is a RGB data and the four-channel data is a RGBW data.

* * * * *